United States Patent [19]

Tusinski et al.

[11] Patent Number: 4,561,213

[45] Date of Patent: Dec. 31, 1985

[54] APPARATUS FOR POLISHING THE EDGES OF LENSES

[75] Inventors: Joseph Tusinski; Brian R. Barnes; Herbert H. Mathews, all of Muskogee, Okla.

[73] Assignee: Coburn Optical Industries, Inc., Muskogee, Okla.

[21] Appl. No.: 370,860

[22] Filed: Apr. 22, 1982

[51] Int. Cl.[4] ..... B24B 5/00

[52] U.S. Cl. ..... 51/105 LG; 51/106 LG; 51/284 E

[58] Field of Search ... 51/101 LG, 105 LG, 106 LG, 51/284 E, 97 NC; 192/70.15, 79, 89 R

[56] References Cited

U.S. PATENT DOCUMENTS

| | | | |
|---|---|---|---|
| 980,133 | 12/1910 | Slavin | 51/101 LG |
| 1,145,194 | 7/1915 | Hansen | 51/101 LG |
| 1,310,071 | 7/1919 | Gurry | 51/7 |
| 2,054,985 | 9/1936 | Kraemer et al. | 51/101 LG |
| 2,293,291 | 8/1942 | Gaspari | 51/106 |
| 2,523,568 | 9/1950 | Halverson | 192/93 C |
| 2,575,022 | 11/1951 | Lemay | 51/101 LG |
| 3,145,506 | 3/1962 | Vegors et al. | 51/33 |
| 3,449,866 | 6/1969 | Suddarth | 51/101 |
| 3,513,598 | 3/1967 | Asselin et al. | 51/101 LG |
| 3,736,115 | 5/1973 | Blum | 51/284 |
| 3,745,720 | 7/1973 | Savage | 51/101 LG |
| 4,212,379 | 7/1980 | Zoino | 192/70.15 |

*Primary Examiner*—Frederick R. Schmidt
*Assistant Examiner*—Judy J. Hartman
*Attorney, Agent, or Firm*—John J. Byrne; Bradford E. Kile; Kevin M. O'Brien

[57] ABSTRACT

Disclosed is apparatus for polishing the edges of lenses, such as eyeglass lenses. The apparatus includes a lens holder, a motor for rotating the lens holder, a hand screw mechanism for opening and closing the lens holder, a polishing pad, a motor for rotating the polishing pad, a hand pivot mechanism for pivoting the polishing pad towards and away from the lens holder, a container for polishing abrasive, and a hand screw mechanism for translating the the polishing pad axially to bring different portions of the polishing pad into engagement with lenses gripped by the lens holder.

5 Claims, 8 Drawing Figures

APPARATUS FOR POLISHING THE EDGES OF LENSES

FIELD OF THE INVENTION

This invention relates to apparatus for polishing the edges of lenses, such as eyeglass lenses.

BACKGROUND OF THE INVENTION

In ophthalmic optics, concave-convex lens blanks are formed from glass or plastic, after which a convex surface of the lens blank is mounted upon a retaining member known as a lens block. The lens blank and the lens block are then accurately mounted on a grinding apparatus, and a toroidal or spherical surface having a compound prescriptive value is rough ground into a concave portion of the lens blank. Following the initial grinding operation, the lens (which has ceased to be a lens blank by this point in the process) is fined and then polished to a final prescriptive value. The lens is then mounted on an edge grinding machine, which cuts the outer peripheral shape required to be compatible with the eyeglass frame in which the lens is to be mounted. Next, the edges of the lens between the concave and convex surfaces and the peripheral surface of the lens are bevvelled. Finally, the remaining peripheral surface of the lens is polished to remove any burrs which would interfere with the mounting of the lens.

Various types of manual apparatus for polishing the edges of lenses have of course been in existence for many years. However, the known types of lens edge polishers suffer from a number of more or less serious drawbacks. Most of the prior art designs consist of a buffing pad attached to the shaft of a high-speed motor. A high degree of dexterity is required to manipulate the lenses so that only the desired edge is polished (i.e., so that the working surface of the lenses are not damaged). Moreover, contact of the lenses with the rapidly turning buffing pad sprays the polishing medium around, so that clean-up of the surrounding area is arduous and unpleasant.

OBJECT OF THE INVENTION

It is, therefore, a general object of the invention to provide novel apparatus for polishing the edges of lenses which eliminates or minimizes the foregoing drawbacks of the prior art.

It is a particular object of the invention to increase the productivity of lens grinding laboratories by making the arduous task of polishing the edges of lenses simpler and nearly automatic.

It is a related object of the invention to provide apparatus for polishing the edges of lenses which is nearly automatic and the use of which does not require a great deal of training.

It is another object of the invention to provide apparatus for polishing the edges of lenses in which the lenses are totally enclosed during the polishing operation, thereby avoiding the problem of having to clean up the entire work area.

It is a further object of the invention to provide apparatus for polishing the edges of lenses in which the high-speed buffing pad may be moved relative to the lenses so as to affect longer life of the pad.

It is a related object of the invention to provide apparatus for polishing the edges of lenses in which the splash shields and the polish carrier are easily removed for clean-up.

BRIEF SUMMARY OF THE INVENTION

A preferred embodiment of the invention, which is intended to accomplish at least some of the foregoing objects, includes a lens holder, a motor for rotating the lens holder, a hand screw mechanism for opening and closing the lens holder, a polishing pad, a motor for rotatating the polishing pad, a hand pivot mechanism for pivoting the polishing pad toward and away from the lens holder, a container for polishing abrasive, and a hand screw mechanism for translating the polishing pad axially to bring different portions of the polishing pad into engagement with the lens gripped by the lens holder.

DETAILED DESCRIPTION OF THE PRESENTLY PREFERRED EMBODIMENT

OVERALL DESCRIPTION

Figure 1:
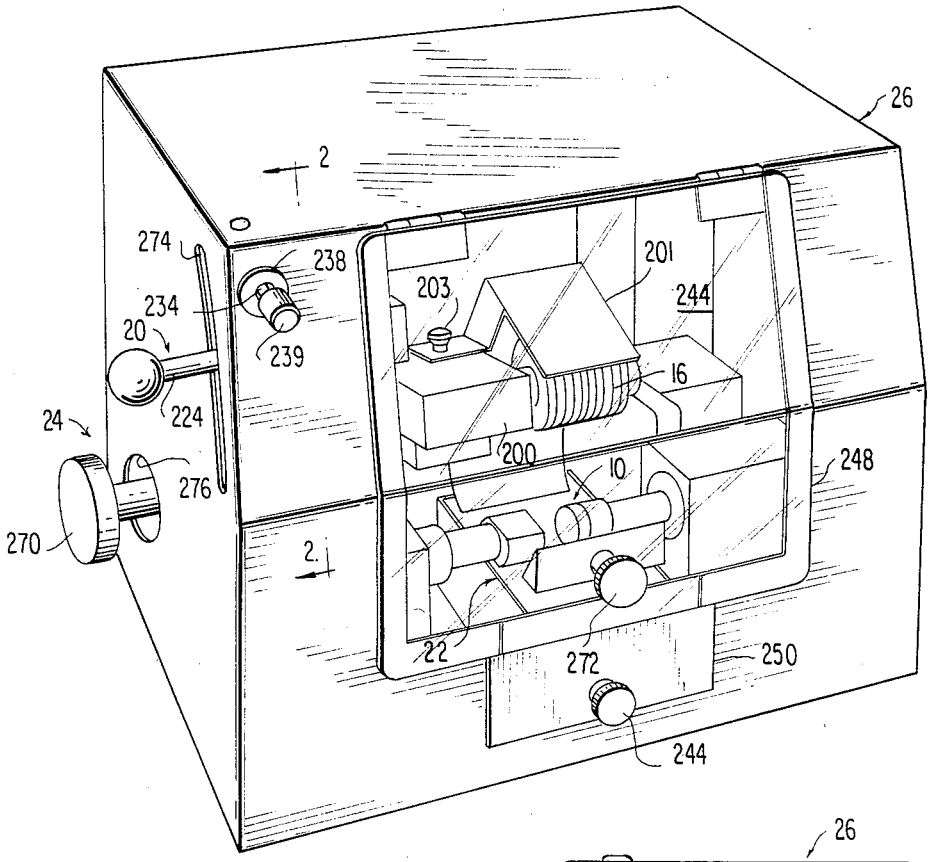
FIG. 1 is a perspective view of the presently preferred embodiment.

Broadly speaking, the ophthamic lens edge polisher shown in the drawings is made up of ten components, or subassemblies. They are a lens holder 10 (seen in FIGS. 1, 3, 7, and 9); a motor 12 (seen in FIG. 4 and 5) for rotating the lens holder 10; a hand screw mechanism 14 (seen in FIGS. 3, 4, 7, and 8) for opening and closing the lens holder 10 on a lens to be polished; a polishing pad 16 (seen in FIGS. 1, 3, and 7); a motor 18 (seen in FIGS. 3, 4, and 5) for rotating the polishing pad 16; a hand pivot mechanism 20 (seen in FIGS. 1, 2, 3, 4, and 5) for pivoting the polishing pad 16 in order to bring it into and out of engagement with lenses gripped by the lens holder 10; a container 22 (seen in FIGS. 1, 3, 4, and 5) for polishing abrasive; a hand screw mechanism 24 (seen in FIGS. 1, 3, 4, and 6) for translating the polishing pad 16 axially to bring different portions of the polishing pad 16 into engagement with lenses gripped by the lens holder 10; electrical controls 25 (see FIGS. 3 and 4); and a housing 26 (seen in FIGS. 1 and 2) for protecting the other components from contamination and for preventing the operator of the polisher from being injured by moving components and being soiled by polishing abrasive during use of the polisher. Each of these components, or subassemblies, will be described in turn.

The Lens Holder 10

The lens holder 10 is composed of two lens gripping jaws 28 and 30 which, in use, grip a lens (not shown) for rotation about a first axis which is generally perpendicular to the lens. The jaw 30 is threaded onto a shaft 32 by a stepped bolt 34. A shoulder 36 on the stepped bolt 34 abuts the adjacent axial face 38 of the shaft 32. The jaw 30 is composed of a cylindrical metallic block 40 and a ring-shaped resilient pad 42. The metallic block 40 has a clearance hole 44 for the unthreaded shaft 46 of the stepped bolt 34 and a chamfered recess 48 for the head 50 of the stepped bolt 34. It will be observed that the length of the unthreaded shaft 46 is slightly greater than the length of the clearance hole 44, so the block 40 has some axial play relative to the stepped bolt 34, the axial position of which is fixed by the shoulder 36. The ring-shaped resilient pad 42 is glued to the adjacent axial surface of the block 40, and its central opening 52 provides access to the head 50 of the stepped bolt 34.

The jaw 28 is mounted on a shaft 54 by a pin 56. The pin 56 is press fit in a through hole 58 in the shaft 54, and its protruding ends 60 and 62 are received in slots 64 and 66 in the jaw 28. This construction permits axial play in the positioning of the jaw 28 relative to the shaft 54, and it permits the jaw 28 to be easily slipped off the end of the shaft 54 after the jaw 30 has been moved to the right in FIG. 7.

The jaw 28 is formed from metal, is generally cylindrical in external configuration, and has a symetrically stepped axial through bore 68. The through bore 68 has a large diameter portion 70 which slidingly receives the end of the shaft 54, a large diameter portion 72 which accepts various designs of chucking blocks used during the process of edging lenses, and a small diameter portion 74 which provides communication between the large diameter portion 70 and the large diameter portion 72. The protruding ends 60 and 62 of the pin 56 abut against the closed ends of the slots 64 and 66 well before the end of the shaft 54 abuts against the bottom of the large diameter portion 70 of the stepped through bore 68, leaving a chamber 76 in the jaw 28.

Jaw 28 is slidably removable from shaft 54, and slots 78, 80, and 82 are provided to accept various designs of chucking blocks. However, a given operator will generally use one type only. The chucking blocks adhere to the lens by adhesive means; hence, when the jaws 28 and 30 rotate, the lens will not slip, causing scratching of the optical surface. Slots 78, 80, and 82 insure that the lens and the jaw 28 rotate in unison. The flat portions 84, 86 insure the alignment of the lens with respect to the polishing pad.

The Motor 12

The motor 12 is bolted to an upright 87 which in turn is bolted to base plate 88. A pulley 90 is mounted on the output shaft 92 of the motor 12, and a belt 94 is trained over the pulley 90. The belt 94 is also trained over a pulley 96 mounted on a shaft 98. Thus, rotation of the motor 12 causes rotation of the shaft 98. The shaft 98 is rotatably received in bearings 100 and 102 in bearing block 104 (see FIG. 7) and in similar bearings (not shown) in bearing block 106. Collars 108 and 109 prevent left and right axial motion of the shaft 98. Bearings 100 and 102 in the bearing block 104 and the similar (unshown) bearings in the bearing block 106 are pressed into the blocks and do not require retainers.

A pulley 110 is mounted on the shaft 98 adjacent the bearing block 106, and a belt 112 is trained over the pulley 110. The belt 112 is also trained over a pulley 114 mounted on the shaft 54. An idler pulley 116 is mounted on a shoe 118 in contact with the belt 112. The shoe 118 is adjustably mounted on the bearing block 106 by a slot 120 in the shoe 118 and a bolt 122 which passes through the slot 120 and is threadedly received in the bearing block 106, thus permitting adjustment of the tension in the pulley 110. The shaft 54 is rotatably received in bearings 124 and 126 in bearing block 106. Thus, rotation of the shaft 98 causes rotation of the shaft 54, to which the lens gripping jaw 28 is mounted as previously explained.

A pulley 128 is mounted on the shaft 98 adjacent the bearing block 104, and a belt 130 is trained over the pulley 128. The belt 130 is trained over a pulley 132 mounted indirectly on the shaft 32. An idler pulley 131 is mounted on an adjustable shoe 133 to permit adjustment of the tension in the belt 130 in the same fashion that the idler pulley 116 and the adjustable shoe 118 permit adjustment of the tension in the belt 112. However, the pulley 132 is not a simple pulley, but is part of a clutch mechanism which permits the motor 12 to be disengaged from the drive train leading to the lens gripping jaw 30 when it is desired to use the hand screw mechanism 14. The pulley 132 bears axially against a wear pad 134 mounted on the bearing block 104, and it is threadedly mounted on a sleeve 136 which is mounted in a stepped bore 138 in the bearing block 104. A set screw 140 is provided to hold the pulley 132 in fixed position on the sleeve 136. As will be appreciated, the rotational motion of the pulley 132 is accordingly transmitted to the sleeve 136. (A hole 142 in the bearing block 104 and a corresponding hole 144 in the sleeve 136 are shown at the upper left of the bearing block 104 in FIG. 7, but they are used only during assembly and maintenance to temporarily prevent rotation of the sleeve 136 while the pully 132 is being screwed onto it or off it.)

An axial thrust bearing 146 is provided between the enlarged head 148 of the sleeve 136 and a shoulder 150 in the stepped bore 138, and rotary bearings 152 and 154 are provided between the body 156 of the sleeve 136 and the bearing block 104. The body 156 of the sleeve 136 contains a stepped bore 158, and a threaded insert 160 is press fit in the larger diameter portion 162 of the stepped bore 158 until it seats against a shoulder 164 in the stepped bore 158. The shaft 32 in turn is threadedly received in the threaded insert 160. A clutch cone 166 (described in detail hereinafter) prevents the shaft 32 from turning in the threaded insert 160 under normal conditions. Thus, rotation of the sleeve 136 causes rotation of the shaft 32, to which the lens gripping jaw 30 is mounted as previously explained. Of course, the various pulleys are sized so that the lens gripping jaws 28 and 30 rotate at substantially the same speed.

The Hand Screw Mechanism 14

Figures 7, 8, 9:
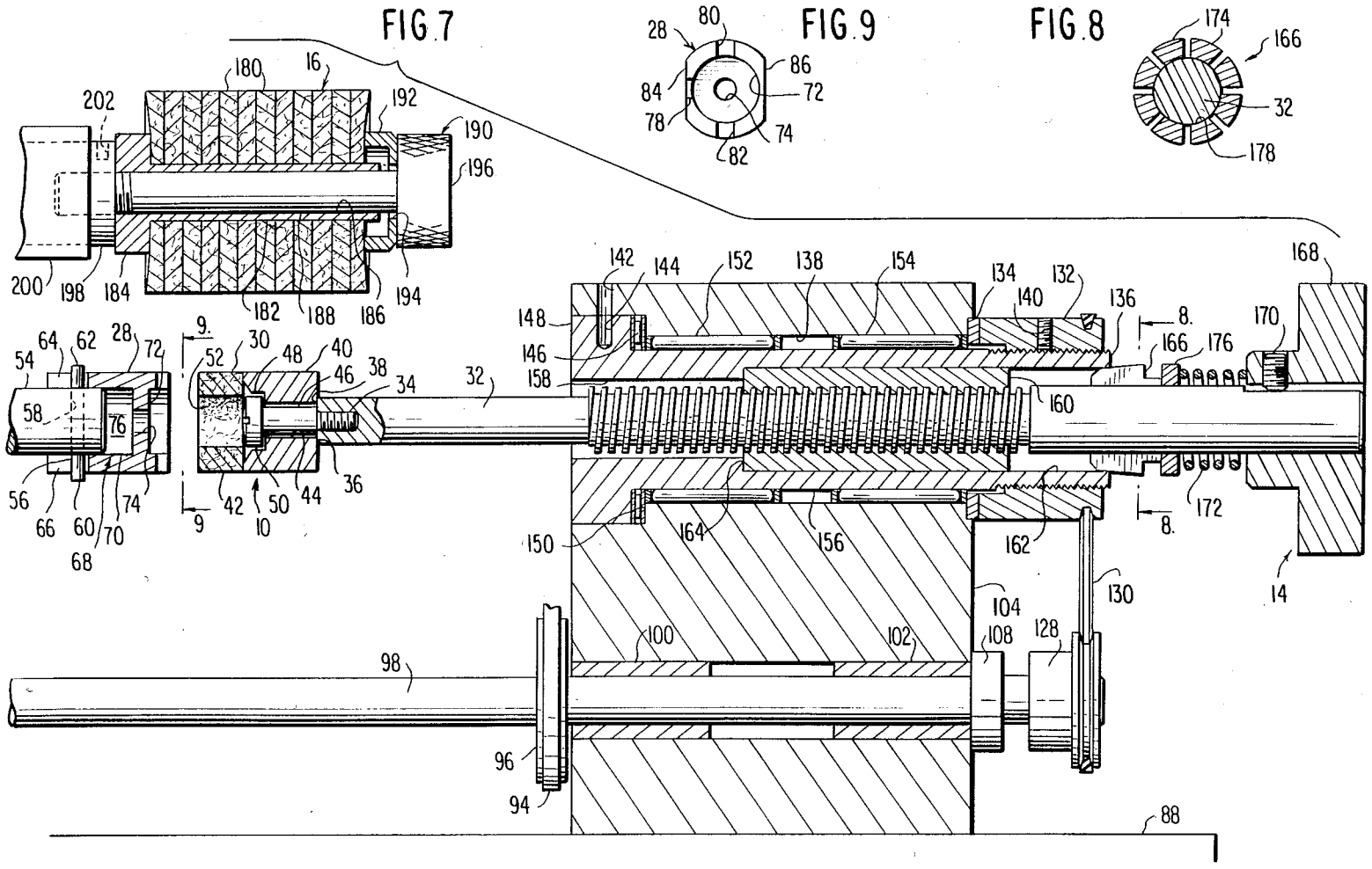
FIG. 7 is a sectional view along the line 7—7 in FIG. 4.
FIG. 8 is a sectional view along the line 8—8 in FIG. 7.
FIG. 9 is a view along the line 9—9 in FIG. 7.

The hand screw mechanism 14 is provided to translate the lens gripping jaw 30 axially in order to release or grip a lens between the lens gripping jaws 28 and 30. As best seen in FIG. 7, the shaft 32 extends through the clutch cone 166, and a knurled knob 168 is affixed to the end of the shaft 32 by a set screw 170. A compression spring 172 surrounds the shaft 32 and bears at one end against the knob 168 and at the other end against the clutch cone 166, tending to force the latter into engagement with the sleeve 136.

As best seen in FIG. 8, the clutch cone 166 is formed with a plurality of segments 174 extending from a base 176. The segments 174 form a segmented, truncated cone, the smaller end of which fits into the larger diameter portion 162 of the stepped bore 158, but the larger end of which does not. The central bore 178 of the clutch cone 166 is larger than the external diameter of the shaft 32, so that the shaft 32 can rotate freely relative to the clutch cone 166 when the clutch cone 166 is in its relaxed state. However, the clutch cone 166 is formed from resilient steel, and when the smaller end of the clutch cone 166 is forced into the larger diamter portion 162 of the stepped bore 158 by the compression spring 172, the segments 174 are forced radially inwardly by a wedging action between the periphery of the segments 174 and the embouchure of the radial bore 158. When the segments 174 have been forced sufficiently far inwardly, they come into gripping engagement with the shaft 32, preventing relative rotational motion of the sleeve 136 and the shaft 32. When the clutch cone 166 is so engaged, the drive train of the motor 12 extends positively from the motor 12 to the shaft 32, as previously explained.

When it is desired to translate the lens gripping jaw 30 axially in order to release or grip a lens between the lens gripping jaws 28 and 30, the knob 168 is turned by hand. As will be recalled, the threaded insert 160 is press fit in the sleeve 136, so rotational motion of the knob 168 tends to turn the sleeve 136 in the bearing block 104 without causing the threads on the shaft 32 to turn relative to the threaded insert 160. However, the sleeve 136 is fixed to the pulley 132, as previously described, and the pulley 132 is part of a drive train leading from the motor 12. The inertia of that drive train, particularly including the internal inertia of the motor 12, is sufficient to hold the pulley 132, and thus the sleeve 136 and the threaded insert 160, against rotational motion due to the hand-generated turning of the shaft 32. Accordingly, the threaded insert 160 remains stationary while the shaft 32 is screwed to the left or the right, depending on the direction in which the knob 168 is turned.

When the shaft 32 is threaded far enough to the left in FIG. 7 to bring the clutch cone 166 into engagement with the sleeve 136, the inertia of the motor 12 causes slip motion between the segments 174 and the embouchure of the stepped bore 158 and/or between the segments 174 and the shaft 32. At that point, the knob 168 is turned only with some effort. However, once the shaft has been moved far enough to the right to bring the clutch cone 166 out of engagement with the sleeve 136, the knob 168 turns very easily.

The Polishing Pad 16

As best seen in FIG. 7, the polishing pad 16 is formed from a plurality of fibrous discs 180. The fibrous discs 180 are press fit onto a shaft 182 which has an integral head 184. The shaft 182 has a through bore 186 which receives the unthreaded shank 188 of a bolt 190. A cup-shaped member 192 having a through hole 194 in its bottom is received over the shank 188. The head 196 of the bolt 190 bears against the bottom of the cup-shaped member 192, and the top of the cup-shaped member 192 bears axially against the adjacent fibrous disc 180.

The bolt 190 is threadedly received in a shaft 198 rotatably received in a bearing plate 200. However, a hole 202 is provided in the shaft 198 so that a pin may be inserted into the hole 202 and grasped to prevent rotational motion of the shaft 198. With the shaft 198 held solid, turning of the bolt 190 in one way grips the polishing pad 16 firmly between the head 184 of the shaft 182 and the cup-shaped member 192. Turning the bolt 190 in the other way releases the assembly comprising the polishing pad 16, the shaft 182, the bolt 190, and the cup-shaped member 192. That assembly may be replaced as a unit, or it may be further disassembled and one or more of its component parts (typically the fibrous discs 180) replaced.

A shield 201 which partially surrounds the polishing pad 16 is provided to prevent polishing abrasive from being spun off the fibrous discs 180 and onto the other components of the polisher. The shield 201 is releasably mounted on the bearing plate 200 by means of a thumb screw 203.

The Motor 18

The motor 18 is bolted to an upright 204. The upright 204 is connected to the bearing plate 200 by hinge 206 and biased away from the bearing plate 200 by compression spring 208. The output shaft 210 of the motor 18 extends through the upright 204, and a pulley 212 is mounted on the shaft 210 on the opposite side of the upright 204 from the motor 18. A belt 214 is trained over the pulley 212 and over a pulley 216 mounted on the shaft 198. The force of the compression spring 208 keeps the belt 214 tautly mounted on the pulleys 212 and 216, and rotation of the motor 18 causes corresponding rotation of the shaft 198 and thus of the polishing pad 16.

The Hand Pivot Mechanism 20

The hand pivot mechanism 20 is provided for translating the polishing pad 16 in a plane perpendicular to its axis to bring it into and out of engagement with lenses gripped by the lens holder 10. The bearing plate 200 is mounted for limited pivotal movement about shaft 218, which is journaled at either end in uprights 220 and 222. (Of course, there can be bearing surfaces between the bearing block 200 and the shaft 218 and/or between the shaft 218 and the uprights 220 and 222.)

A handle 224 is attached to a mounting block 226, and the mounting block 226 is attached to the bearing plate 200. Thus, manual manipulation of the handle 224 pivots the bearing plate 200 about the shaft 218. Since the polishing pad 16 is mounted on the bearing plate 200, manual manipulation of the handle 204 likewise pivots the polishing pad 16 through an arc centered in the shaft 218.

The force of gravity tends to bias the polishing pad downwardly toward the lens holder 10. The polishing pad 16 can be held away from the lens holder 10 manually, but, in order to allow the operator to use both hands to insert and remove a lens to be edge-ground, a latch detent mechanism 228 (shown in FIG. 2) is provided. The latch detent mechanism 228 includes a hook 230 which is pivotally mounted on a shaft 232 which in turn is journalled in the housing 26, a manually operated arm 234 which is connected to the hook 230 at a point remote from the shaft 232, and a tension spring 236 which biases the arm 234 (and thus the hook 230) in the clockwise direction in FIG. 2. The arm 234 extends through a grommet 238 in the housing 26, and a handle 239 is mounted on the external end of the arm 234. Thus, the arm 234 can be manipulated to swing the hook 230 into and out of engagement with the handle 224. When the hook 230 is in engagement with the handle 224, it holds the polishing pad 16 away from the lens holder 10. When the hook 230 is out of engagement with the handle 224, the handle 224 can be manipulated manually to pivot the polishing pad 16 toward or away from the lens holder 10.

The Container 22

The container 22 is provided to hold polishing abrasive spaced in proximity to the lens holder 10 so that, in use, a lens gripped by the lens holder 10 picks up a coating of polishing abrasive on its edges as it is rotated. It is supported by two blocks 240 and 242 mounted on the base plate 88, and it is held in position by knob 244 which is threaded into hole 246 in block 242. When the window 248 is pivoted up, the container 22 can be easily removed for cleaning and refilling. When the window 248 is pivoted down, the upper portion of a flange 250 on the front of the container 22 is held between the window 248 and the main part of the housing 26.

The Hand Screw Mechanism 24

The hand screw mechanism 24 serves to translate the polishing pad 16 axially to bring different portions of the polishing pad 16 into engagement with the lens gripped by the lens holder 10. As previously described, the polishing pad 16 is rotatably received in the bearing plate 200, and the motor 18 is bolted to an upright 204 which is hinged to the bearing plate 200 at 206. The bearing plate 200 in turn is mounted on the shaft 218, and, as previously described, it can be pivoted about the shaft 218 by the hand pivot mechanism 20 in order to bring the polishing pad 16 into and out of engagement with lens gripped by the lens holder 10. Moreover, it will now be explained how the bearing plate 200 can be translated axially on the shaft 218, thereby causing lateral movement of both the polishing pad 16 and the motor 18.

Figure 6:
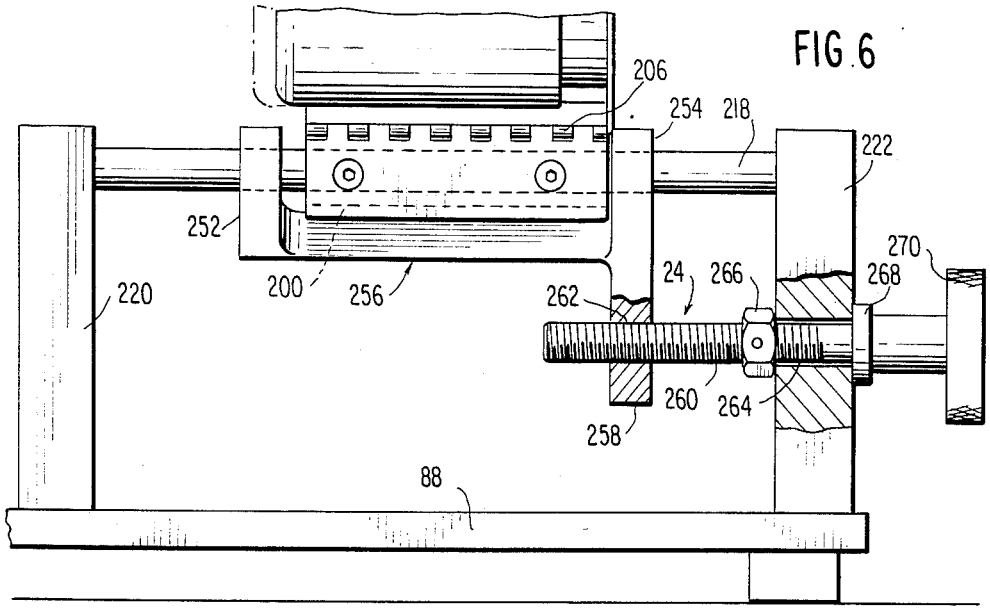
FIG. 6 is a fragmentary rear view of a portion of the presently preferred embodiment with the housing removed.

As best seen in FIG. 6, the shaft 218 passes through the two arms 252 and 254 of a yoke 256 on either side of the bearing plate 220. An extension 258 of the yoke 256 depends downwardly from the yoke 256, and a threaded shaft 260 is threadedly received in the extension 258 at 262. An unthreaded shank 264 of the threaded shaft 260 is journalled in the upright 222, and a nut 266 and a collar 268 prevent lateral movement of the threaded shaft 260 relative to the upright 222. A knurled handle 270 is provided on the exterior end of the threaded shaft 260. As will be apparent, manual rotation of the knurled handle 270 will cause the yoke 256 to move left or right on the shaft 218, and, as the yoke 256 moves left or right, its arms 252 or 254 will bear on the bearing plate 220, also causing it to move left or right on the shaft 218.

It should be noted that bearing plate 200 is free to move a limited amount between arms 252 and 254. This loose constraint allows the polishing pad 16 to follow complex lens curvatures.

The Electrical Control 25

Figure 3:
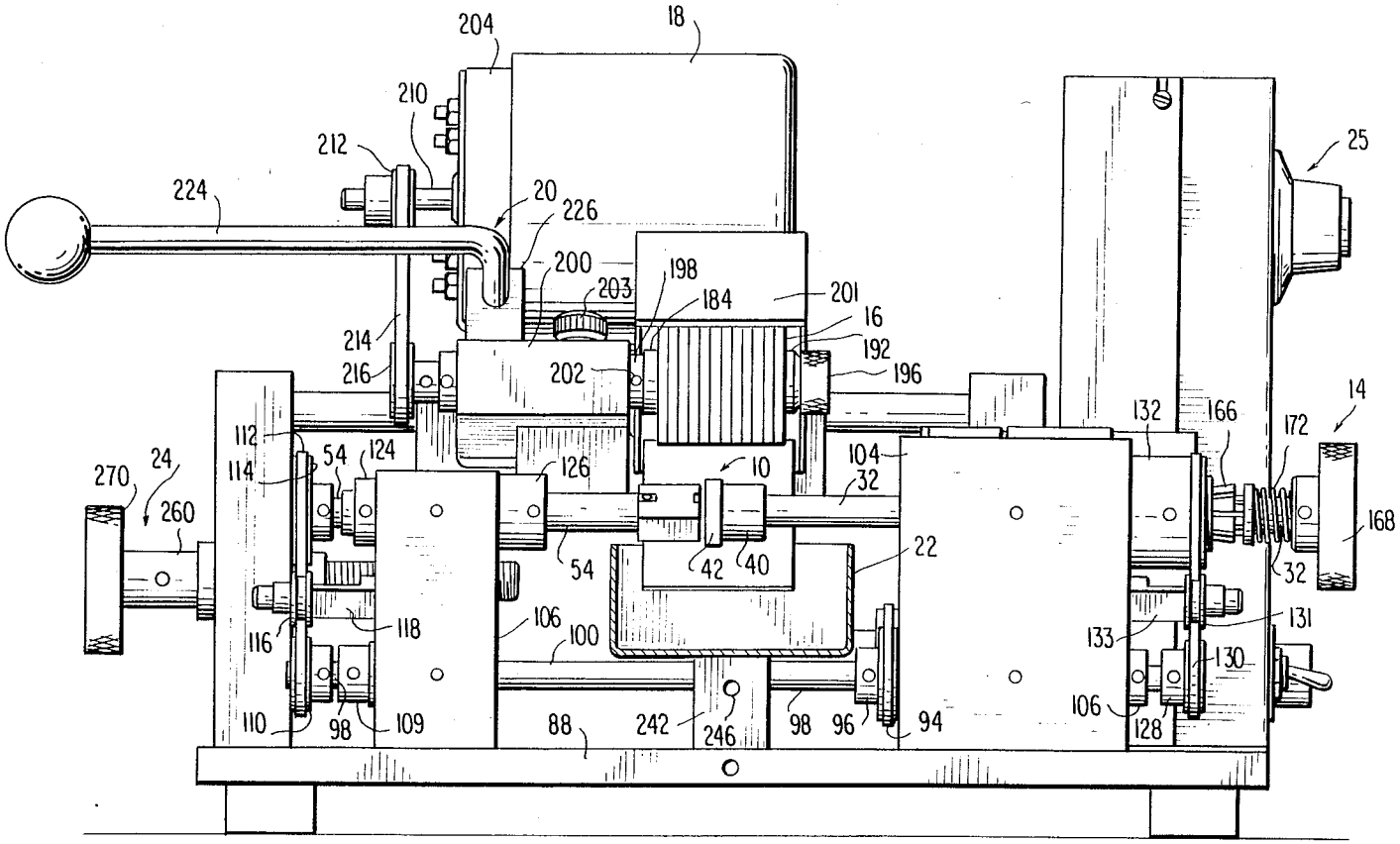
FIG. 3 is a front, partly sectional view of the presently preferred embodiment with the housing removed.
Figure 4:
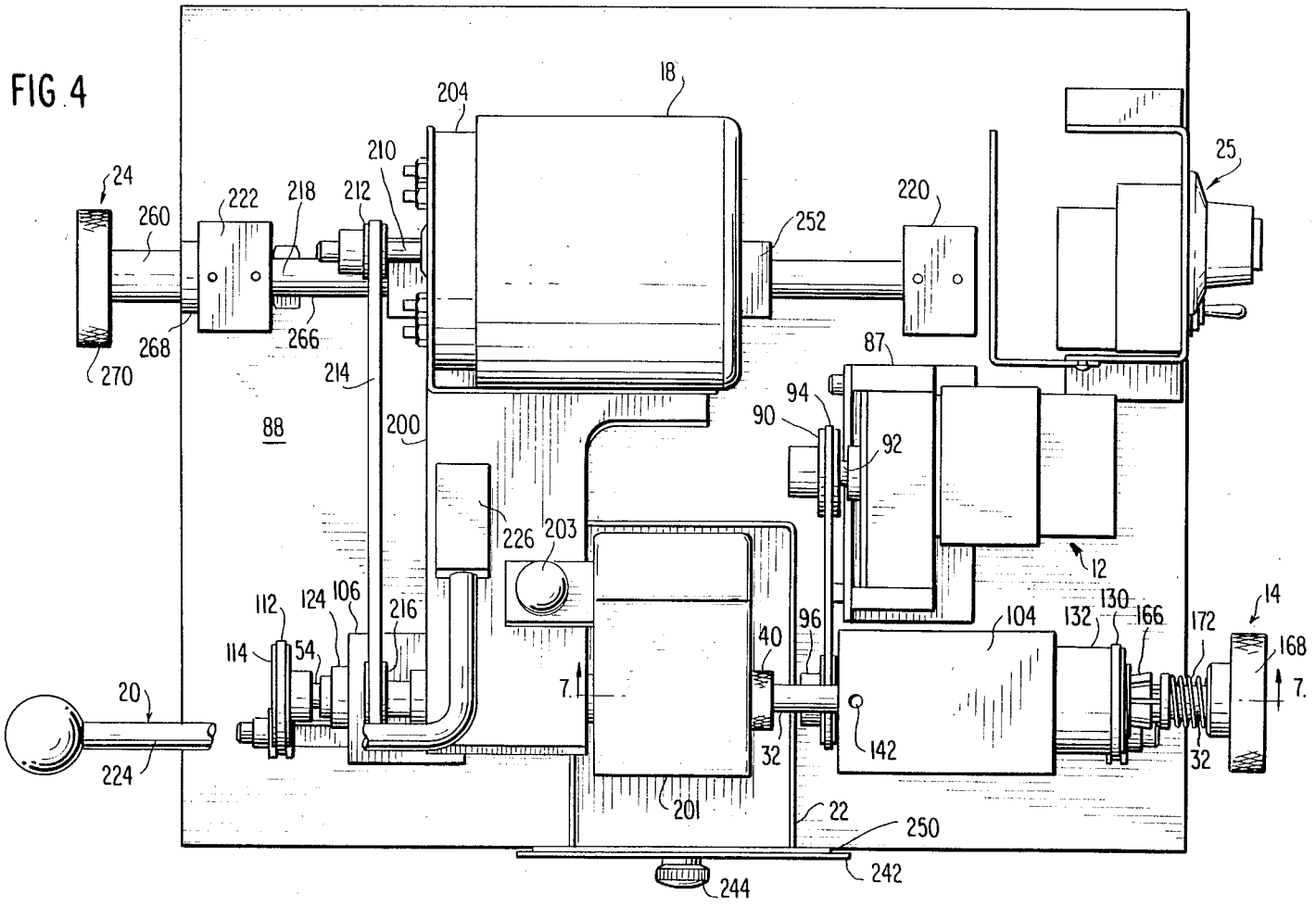
FIG. 4. is a top plan view of the presently preferred embodiment with the housing removed.
Figure 5:
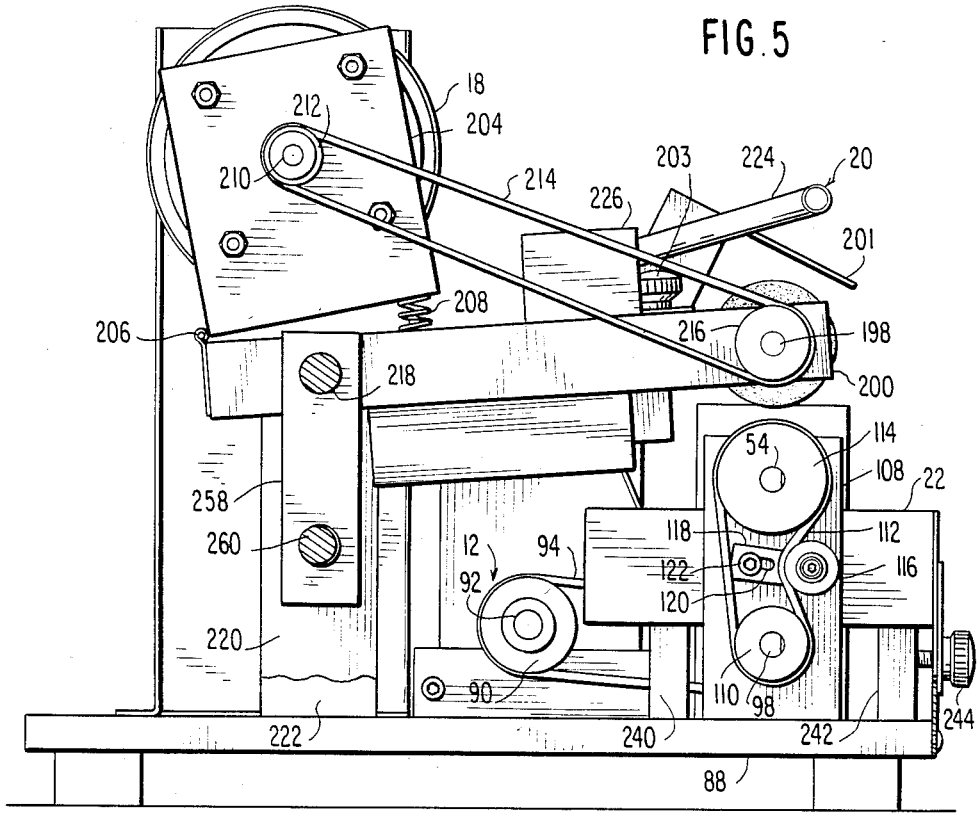
FIG. 5 is a left-side view of the presently preferred embodiment with the housing removed.

The electrical controls 25 for the motors 12 and 18 are conventional and are therefore shown only in schematic form in FIGS. 3 and 4.

The Housing 26

Figure 2:
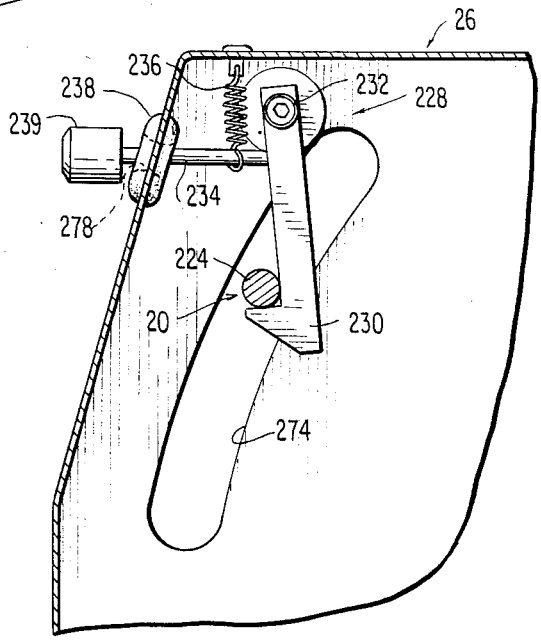
FIG. 2 is a sectional view along the line 2—2 in FIG. 1.

The housing 26 is provided to protect the other components from environmental contamination and to prevent the operator of the polisher from being injured by moving components or being soiled by polishing abrasive during use of the polisher. It is basically simply a box of any convenient and esthetically pleasing shape. Its bottom edge rests on the base plate 88, and it is preferably attached to the base plate 88 by an easy-release mechanism. As previously described, a pivotable window 244 is provided on the front of the housing 26 to permit the operator to view the edge polishing operation, and a handle 272 is provided on the window 244 to permit the operator to pivot open the window, providing limited acess to the interior of the polisher. As shown in FIGS. 1 and 2, a slot 274, a hole 276, and a hole 278 (in the grommet 238) are provided to permit the handle 224, the handle 270, and the handle 239, respectively, to protrude through the housing 26. Although not shown, it will be appreciated that similar apertures are provided on the other side of the housing for the knurled knob 168 and the externally visible components of the electric controls 25.

Caveat

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

We claim:

1. Apparatus for polishing the edges of lenses, said apparatus comprising:

a lens holder comprising two lens gripping jaws which, in use grip a lens for rotation about a first axis which is generally perpendicular to the lens;

first means for rotating said lens holder;

second means for translating one of said gripping jaws axially in order to release or grip a lens between said gripping jaws;

a polishing pad mounted for rotation about a second axis parallel to but spaced from said first axis, said polishing pad is cylindrical in shape and symmetrical about said second axis;

third means for rotating said polishing pad about said second axis;

fourth means for translating said polishing pad in a plane perpendicular to said second axis to bring it into and out of engagement with a lens as gripped by said lens holder;

fifth means for translating said polishing pad axially to bring different portions of said polishing pad into engagement with lenses gripped by said lens holder, said fifth means including, means for operably permitting a degree of free, random, axial travel of said polishing pad along said second axis during a second axis polishing operation;

said second means comprising;

a bearing block, a sleeve which is journalled for rotation in said bearing block and which is rotated by said first means, said sleeve having a threaded through bore therein; sixth means for preventing axial movement of said sleeve.

a shaft on which said one of said gripping jaws is mounted, said shaft having external threads which are received in the threads in said through bore in said sleeve, and seventh means for rotating said shaft relative to said sleeve including a clutch which, when engaged, causes said shaft to turn with said sleeve and which, when disengaged permits said shaft to turn relative to said sleeve; and a container for polishing abrasive spaced in proximity to said lens holder in position so that, in use, a lens gripped by said lens holder picks up a coating of polishing abrasive on its edges as it is rotated.

2. Apparatus as recited in claim 1 wherein said clutch comprises a cone mounted on said shaft, the smaller end of said cone being received in a mating bore in said sleeve such that when said cone is forced into said mating bore, the smaller end of said cone is distorted radially inwardly and caused to grip said shaft.

3. Apparatus as recited in claim 2 wherein:

(a) said seventh means further comprises a handle mounted on said shaft on the opposite side of said cone from said sleeve and (b) said clutch further comprises a compression spring which bears at one end against said handle and at the other end against said cone.

4. Apparatus as recited in claim 1 wherein:

(a) said polishing pad and said third means are both mounted on a bearing plate;

(b) said bearing plate is mounted for both pivotal and axial movement on a first shaft;

(c) said fourth means causes pivotal movement of said bearing plate about said first shaft; and (d) said fifth means causes axial movement of said bearing plate relative to said first shaft.

5. Apparatus as recited in claim 4 wherein said fifth means comprises:

(a) a yoke which has an arm located adjacent each side of said bearing plate;

(b) a second shaft which is threadedly received in said yoke; and (c) eighth means for preventing axial movement of said second shaft.

* * * * *